US005658171A

United States Patent [19]

Pauza et al.

[11] Patent Number: 5,658,171

[45] Date of Patent: Aug. 19, 1997

[54] SEALED COAXIAL FEEDTHROUGH CONNECTOR

[75] Inventors: William V. Pauza, Palmyra; Harold W. Kerlin, Port Royal; James Ray Fetterolf, Sr., Mechanicsburg; David A. Skotek, Harrisburg, all of Pa.

[73] Assignee: The Whitaker Corporation, Wilmington, Del.

[21] Appl. No.: 549,353

[22] Filed: Oct. 27, 1995

[51] Int. Cl.[6] ..... H01R 17/04

[52] U.S. Cl. ..... 439/675

[58] Field of Search ..... 439/675, 578, 439/581, 63, 589

[56] References Cited

U.S. PATENT DOCUMENTS

| | | | |
|---|---|---|---|
| 4,681,390 | 7/1987 | Hayward | 439/578 |
| 4,904,208 | 2/1990 | Powell et al. | 439/654 |
| 5,011,440 | 4/1991 | Lee | 439/787 |
| 5,041,024 | 8/1991 | Liu et al. | 439/654 |
| 5,096,444 | 3/1992 | Lu et al. | 439/750 |
| 5,242,316 | 9/1993 | Gartzke et al. | 439/584 |
| 5,324,311 | 6/1994 | Acken | 439/675 OR |
| 5,498,175 | 3/1996 | Yeh et al. | 439/578 OR |
| 5,518,420 | 5/1996 | Pitschi | 439/578 OR |

*Primary Examiner*—Gary F. Paumen
*Assistant Examiner*—Daniel Wittels

[57] ABSTRACT

An environmentally, sealed, feedthrough connector of the type that may be used for externally accessing an outdoor TV line amplifier. The connector includes a cylindrical housing having an insert molded contact centrally disposed therein and a deformable O-ring about the insert molded contact. The connector is assembled under an axially compressive force which deforms the O-ring into sealing engagement with the internal wall of the housing.

8 Claims, 8 Drawing Sheets

SEALED COAXIAL FEEDTHROUGH CONNECTOR

BACKGROUND OF THE INVENTION

This invention is directed to a coaxial feedthrough connector that offers internal sealing through a unique construction and method of assembly. The sealing is particularly important where the connector may be exposed to harsh outdoor environments, such as may be found with an exposed TV line amplifier, for example. Such an amplifier, as known in the art, may comprise a metal box, typically hinged with a peripheral seal about the hinged components, signal source and feed outlets, and a printed circuit board positioned therewithin. The printed circuit board may be mounted on a plurality of coaxial connectors, where the board may include a like plurality of probes inserted into a respective said connector. Since such connectors are typically of a feedthrough type, integrity checks may be made externally thereon without having to open the metal box. Notwithstanding this construction, moisture and gasses can often enter through the connector and deleteriously affect the performance of the communication system therewithin.

A feedthrough coaxial connector, which may have application in a TV line amplifier, is disclosed in U.S. Pat. No. 4,681,390. The device thereof is designed to prevent environmental electromagnetic pollution and unauthorized wireless access to the system. This is achieved primarily through the use of a connector housing that internally includes at one end a cavity having an insulating sleeve enclosing a contact assembly, and a concentric cavity at the other end dimensioned and configured to function as a waveguide having a cutoff wavelength which is substantially below the operating wavelength spectrum of the system. This prior art connector seems more suited for indoor applications as there are no means proposed to provide sealing against intrusion of moisture and gasses.

U.S. Pat. No. 5,096,444 represents another approach to a feedthrough F-connector, where the emphasis therein is directed to an end cap insert that facilitates the assembly of the connector. One of the difficulties with connectors of this type is to provide a flat port for the connector. Typically, the connector housing is a machined part that may be restricted at an end to retain the internal parts. However, the opposite end must initially be open to allow access to the assembly therein of the contact and insulating sleeve. Thereafter, some means must be provided to restrict the feed end to contain the internal members. The patentee hereof provides a flat insert or end cap which is fitted into the feed end of the connector housing and abuts against an internal shoulder therein. But again, like the earlier prior art, no suitable sealing is provided that would allow use of this connector in harsh environments.

The present invention, through a unique construction and method of assembly, provides the very important sealing requirement that is necessary for the harsh environment to which the connector may be subjected. This construction and method will become apparent to those skilled in the art from the specification which follows, particularly when read in conjunction with the accompanying drawings.

SUMMARY OF THE INVENTION

This invention is directed to an environmentally sealed coaxial feedthrough coupling connector and to the method of assembly, where the connector may be used for connecting to a contact of a communication system. The coupling connector, or method, comprises selecting a metal housing having a first longitudinal section and a second longitudinal section with an essentially uniform circular cavity of a predetermined diameter therethrough. To initiate the assembly, the first of a pair of insulating sleeves is slidably inserted into the circular cavity. Thereafter, a dielectric insert, which separates the pair of insulating sleeves, is inserted into the cavity. The insert is characterized by an electrical contact extending axially therethrough into the respective insulating sleeves of the assembled connector. The insert is further characterized by a diametrical portion for receipt within the bore, where the diametrical portion includes an annular portion between the sleeves for receiving a compressible O-ring. After insertion of the insert molded contact with O-ring, the second insulating sleeve enters the cavity in abutting relationship therewith. As a final assembly step, an axially oriented flange at the entry end of the housing cavity is crimped inwardly against the second insulating sleeve causing a compressive force against the second sleeve. By this relative axial movement of the sleeves, an axial compression of the O-ring occurs, while at the same time the O-ring laterally expands into sealing contact with the cavity wall, thereby providing an effective, environmental seal against the intrusion of moisture and gasses through the connector.

BRIEF DESCRIPTION OF DRAWINGS

FIGS. 2 and 3 are exploded sectional views illustrating the assembly sequence for the connector of this invention.

DETAILED DESCRIPTION OF PREFERRED EMBODIMENTS

Figure 1:
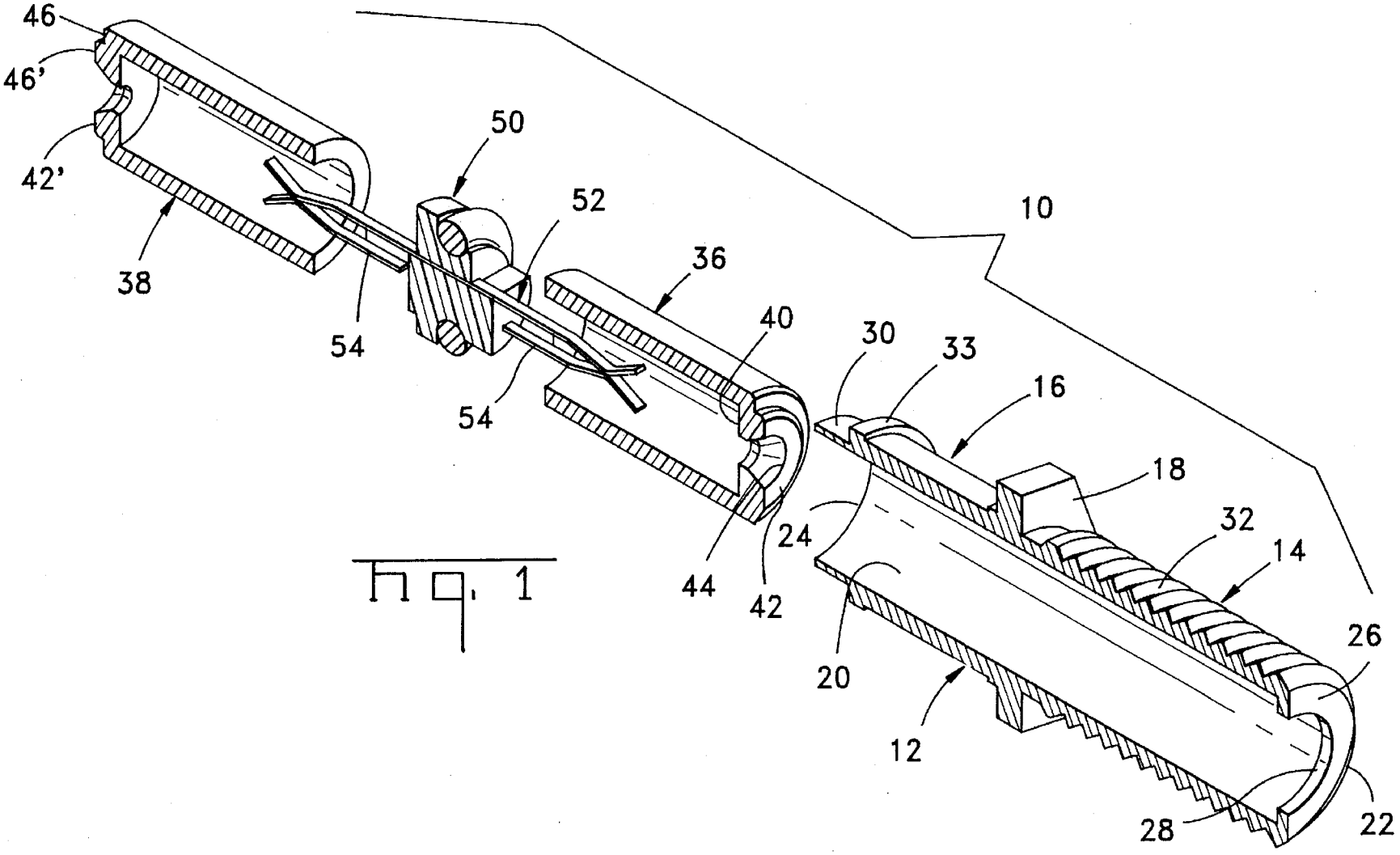
FIG. 1 is an exploded sectional view of the coaxial feedthrough connector of this invention, illustrating the various components of the connector, and the sequence of assembly thereof into the connector housing.
Figure 9:
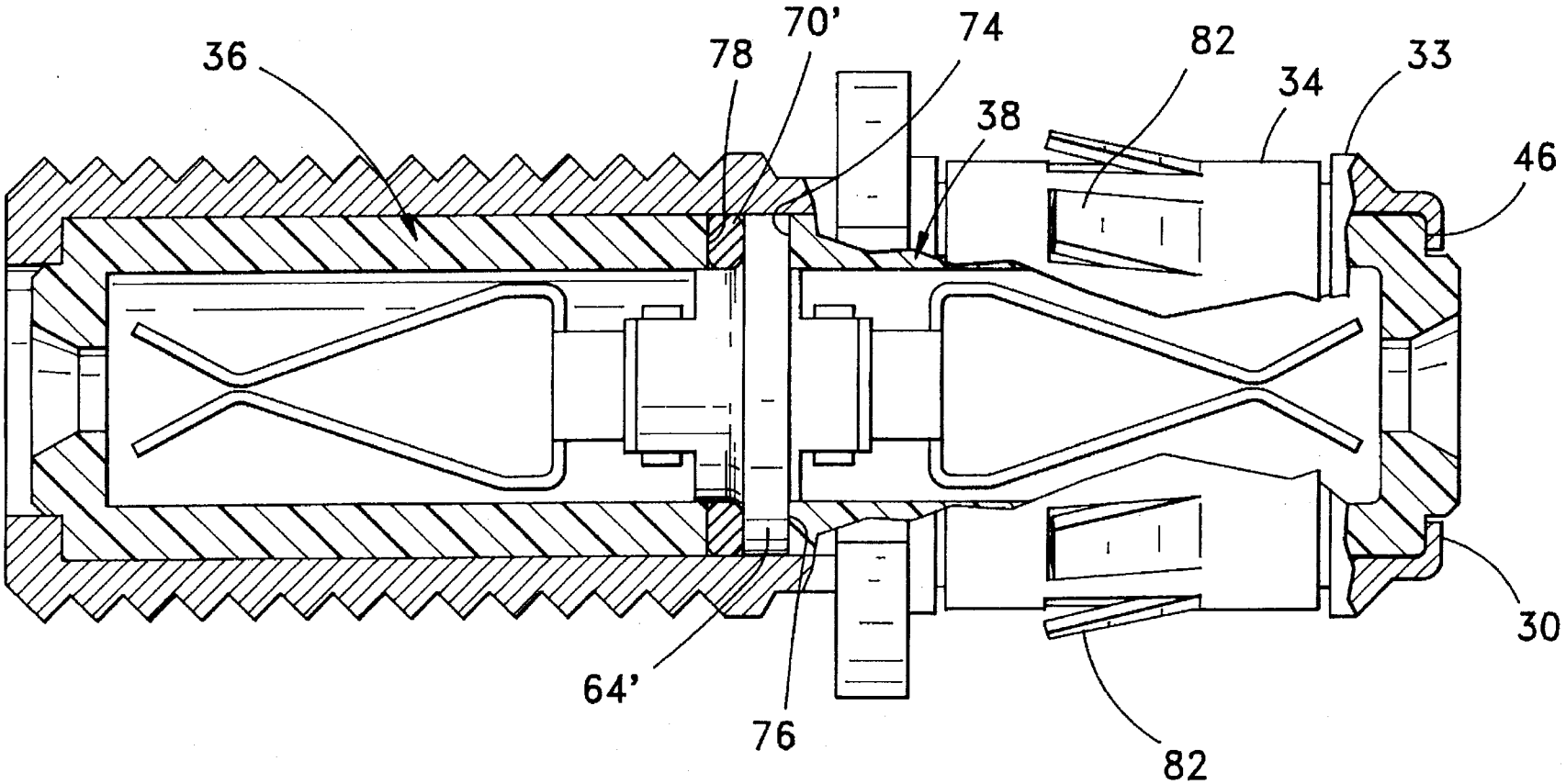
FIG. 9 is a longitudinal sectional view illustrating particularly the laterally deformed O-ring in sealing engagement with the housing wall of the connector.
Figure 10:
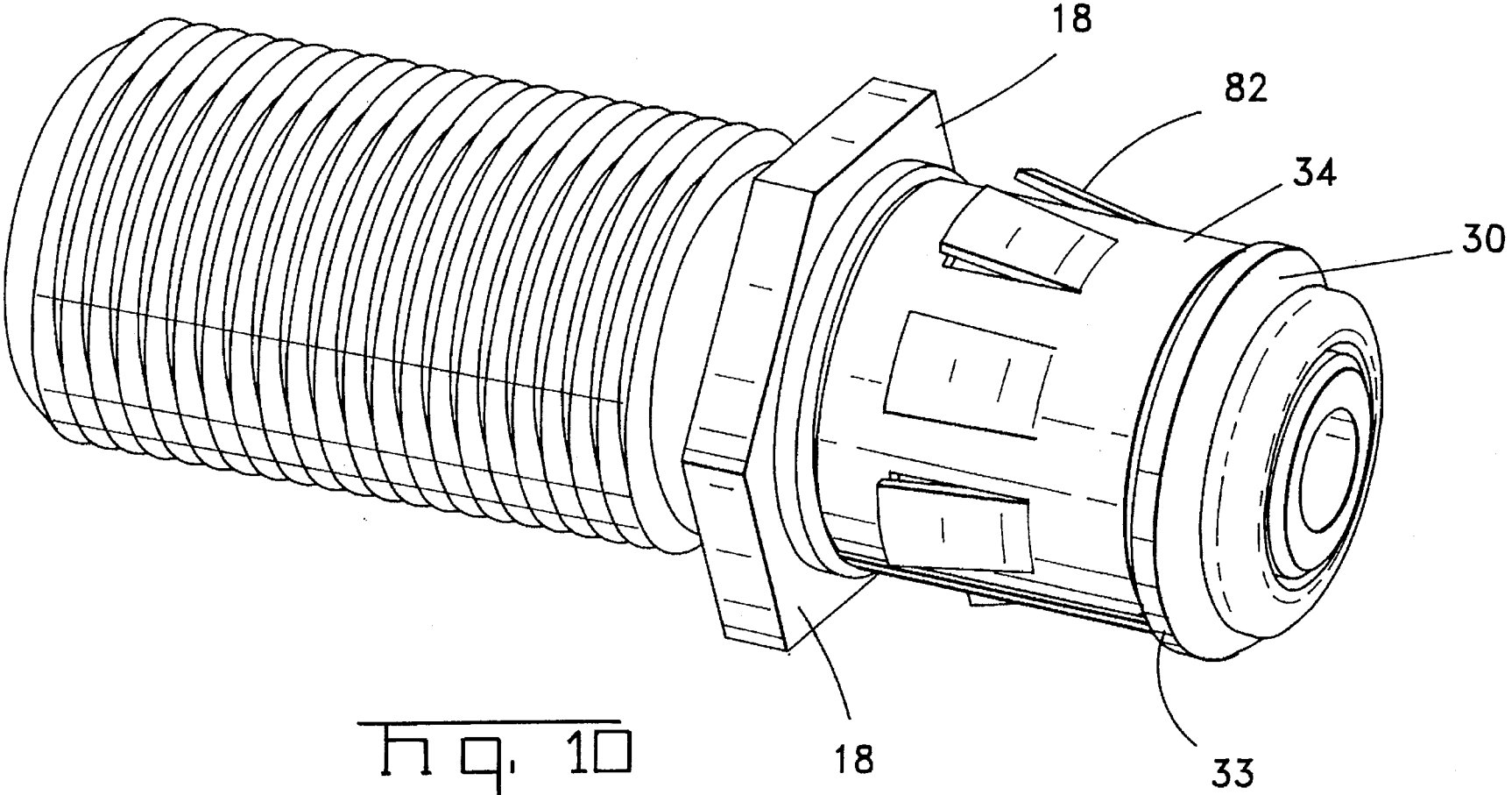
FIG. 10 is a perspective view of the assembled and sealed connector of FIG. 1, including a metal grounding sleeve, with projecting lances, about one end of the connector housing.
Figure 11:
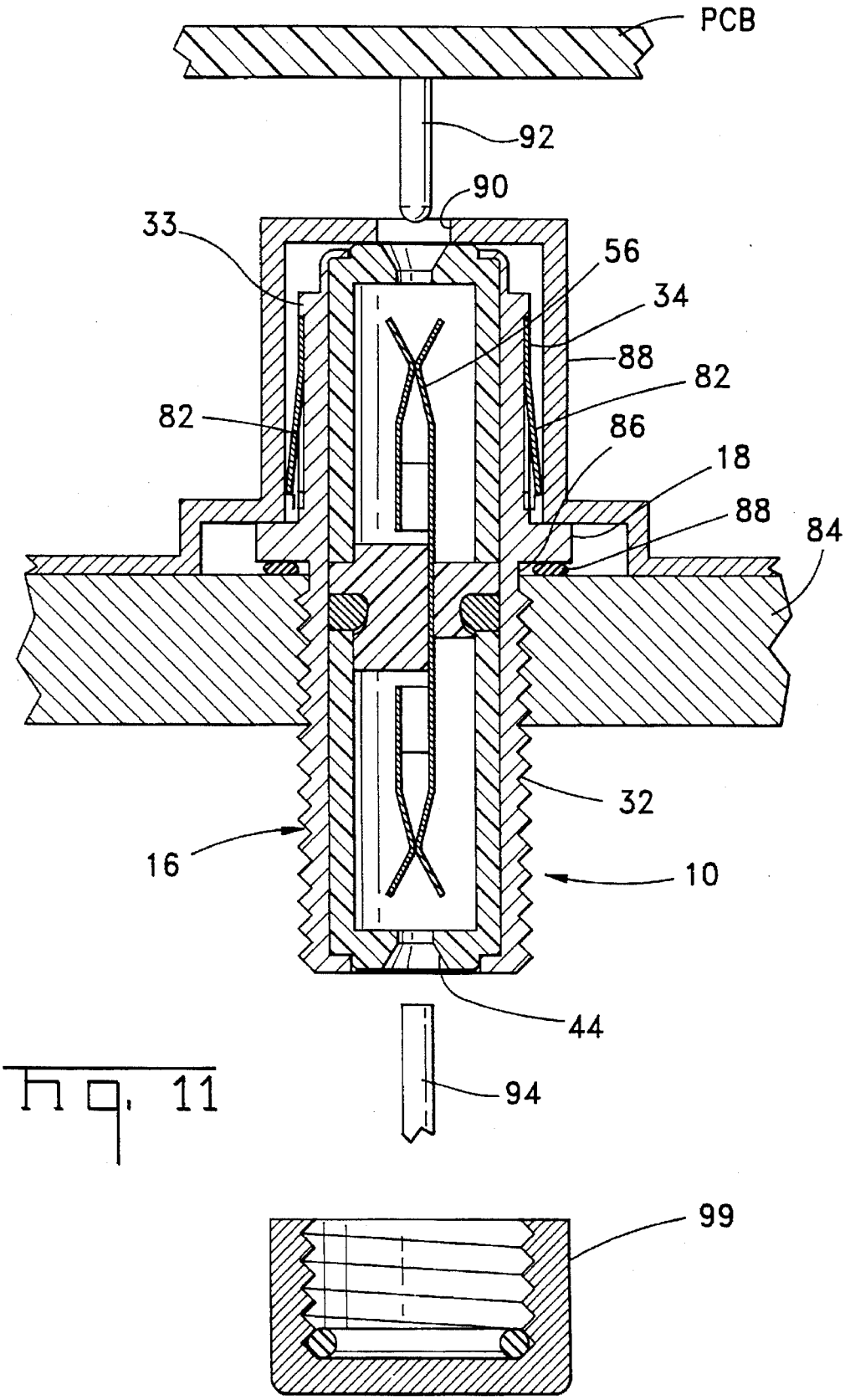
FIG. 11 is an exploded sectional view of the assembled connector hereof, illustrating exemplary components of a typical application for the connector of this invention.

This invention relates to an environmentally sealed coaxial feedthrough connector of the type that may be provided on an outdoor communication outlet, where an electrical integrity check is available to the outlet through the connector. The connector 10, the major components thereof and sequence of assembly being illustrated in FIGS. 1–3. The connector 10 comprises a metal housing 12, typically machined brass and zinc coated, having first and second longitudinal sections 14, 16, defined externally by an annular flange 18 that may cooperate with a hand tool, not illustrated to facilitate threading engagement in a complementary threaded hole of an appropriate communication assembly, see FIG. 11 and later discussion. The housing 12 is characterized by a central bore or cavity 20, having an essentially uniform diameter, a restricted end 22 and a component feed end 24. The restricted end 22 includes an inwardly directed flange 26, or stop, having a restricted central opening 28. The opposite or component feed end 24 includes an axially extending crimping flange 30 concentric with the cavity 20. Finally, externally the housing 12, about the first longitudinal section 14, a threaded portion 32, which as will be apparent hereinafter as seen in FIG. 11, for engagement in a complementary threaded hole. The second longitudinal section 16 includes an annular ring 33, or flange, remote from said annular flange 18, to accommodate between the respective flanges a metal grounding sleeve 34, as illustrated in FIGS. 9–11.

For mounting within said housing 12 are a pair of dielectric inserts 36, 38. The inserts are essentially circular in configuration so as to conform to the housing cavity 20. That is, the respective inserts are dimensioned to be slidably received within the cavity 20. The first said insert 36, sequentially the first to enter the housing 12, includes a restricted end 40 having a concentric rib 42 which defines a probe or contact receiving opening 44. The rib 42 is sized to be received within the housing central opening 28 and against the flange 26. The second said insert 38, through the third component to be assembled into the housing 12 is essentially identical in shape and construction to the first insert 36. Like its companion insert, the restricted end 40' includes a concentric rib 42' surrounded by a shoulder 46, the function of which will be apparent hereinafter.

Figure 4:
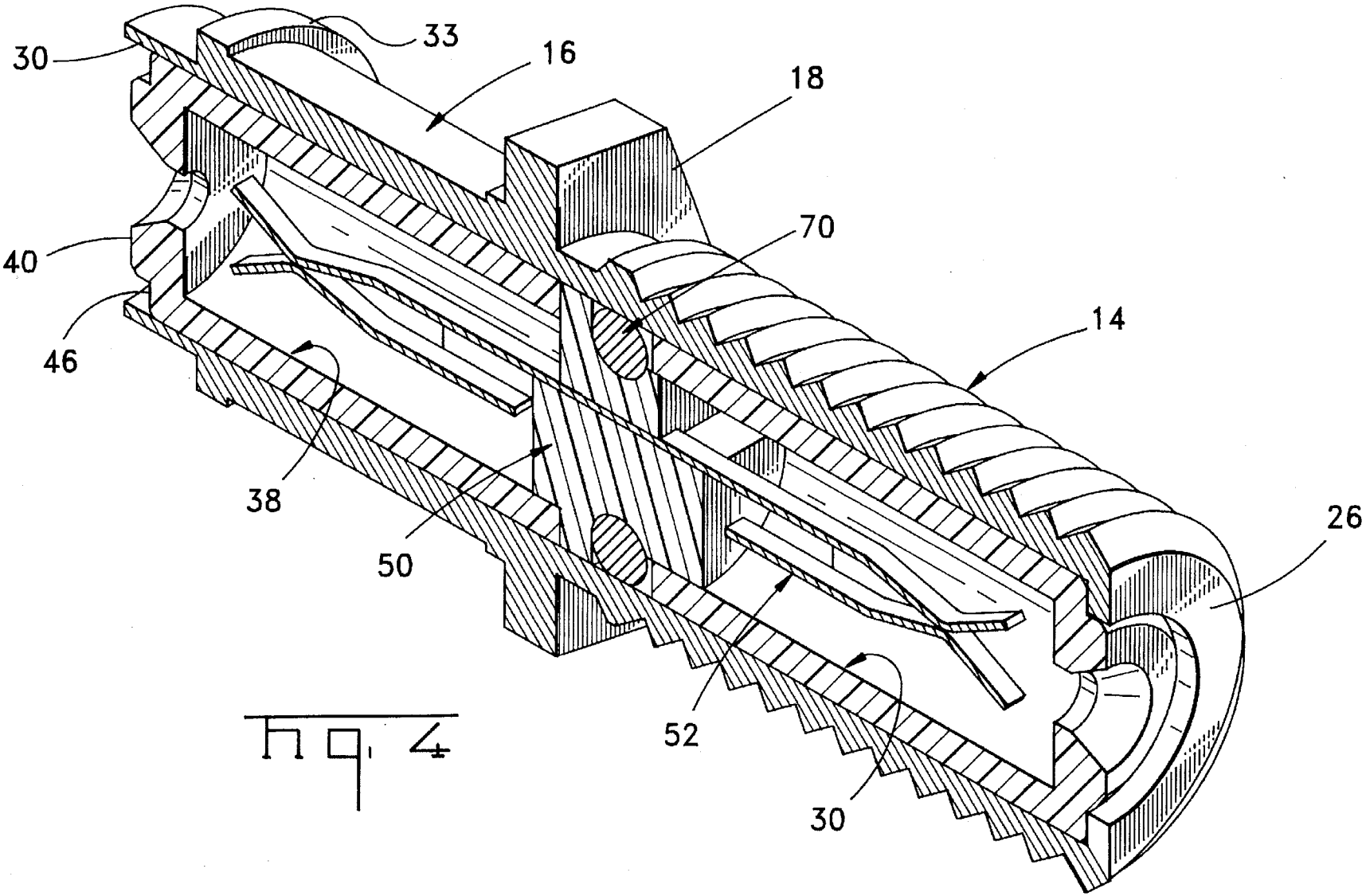
FIG. 4 is an enlarged sectioned perspective view of the assembled connector hereof, prior to the final seating of the components within the connector housing.
Figure 5:
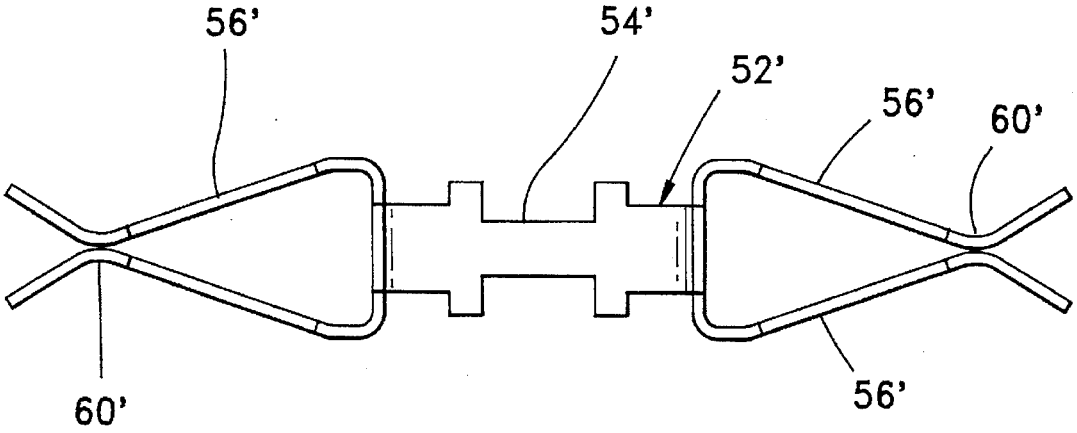
FIG. 5 is a top view of a second embodiment for a formed dual contact element suitable for practicing this invention.
Figure 6:
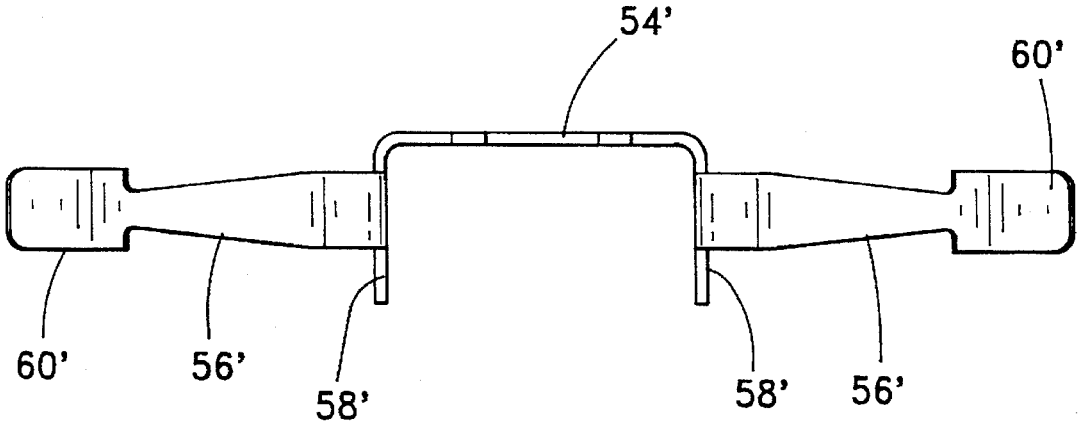
FIG. 6 is a plan view of the formed dual contact of FIG. 5.
Figure 7:
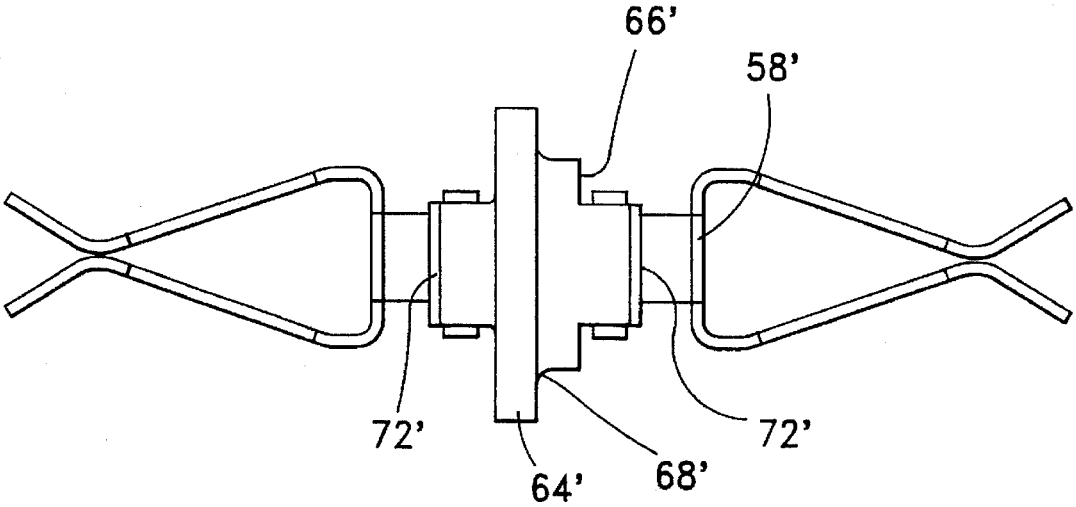

The final major component of the connector 12 is the insert molded element 50, where a single contact 52 is molded therein. The contact 52 is characterized by axially extending arms 54 which are positioned to project into the respective first and second inserts 36, 38. A preliminary concept for the contact 52 is illustrated in FIGS. 1–4, while a preferred contact 52' is detailed in FIGS. 5–8. Before returning to the construction and design of the body of the insert molded element 50, it may be helpful to shift attention to the preferred contact 52' of FIGS. 5 and 6. The contact 52', stamped and formed from a beryllium copper alloy, as known in the electrical connector field, comprises a central U-shaped portion 54' and a pair of cantilevered arms 56' extending in opposite directions normal to the legs 58' of said U-shaped portion 54'. Each arm 56' includes a broad contact end 60'. As best seen in FIG. 5, the respective pairs of arms 56' are shaped or formed to converge toward the contact end 60' and ultimately contact to receive therebetween a contact pin or probe as later discussed.

Figure 7:
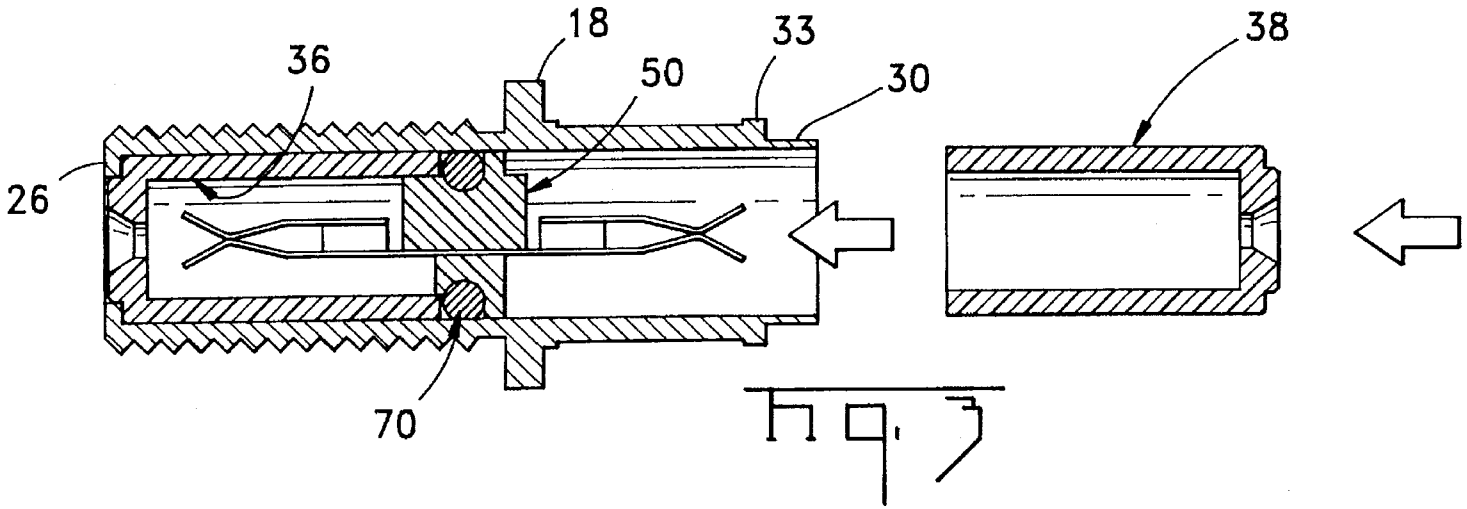
FIG. 7 is a top view of the formed dual contact of FIG. 5, showing the further feature of being insert molded within a dielectric member.
Figure 8:
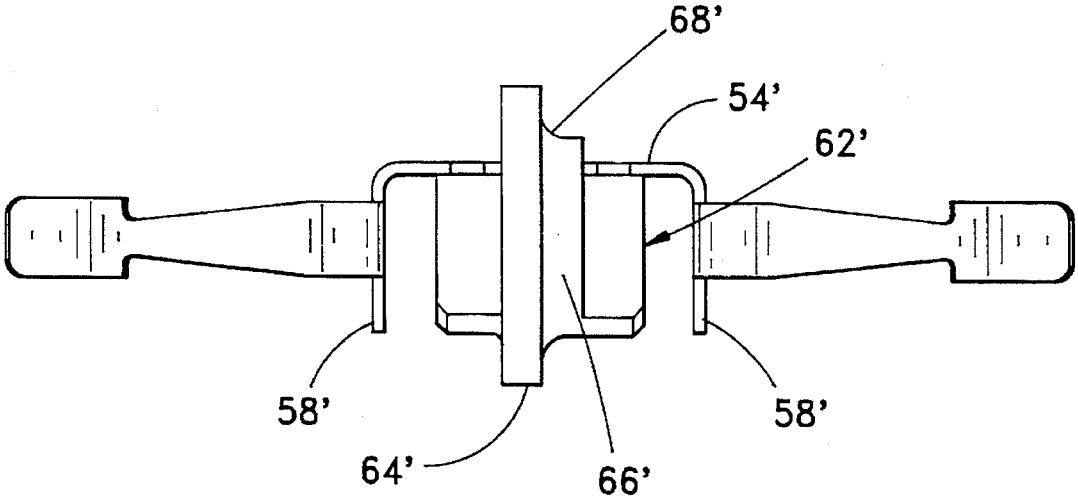
FIG. 8 is a plan view of the insert molded components of FIG. 7.

With the contact 52, 52' so formed or shaped, it is positioned within an injection molding machine, a practice known in the art, where a dielectric body 62' may be molded about the central U-shaped portion 54', more particularly spaced from and between the legs 58'; see FIGS. 7 and 8. In potentially severe environmental applications, it may be desirable to apply a plastic or elastomeric type conformal coating to said central U-shaped portion 54', then cured, prior to the insert molding operation. This application of a cured conformal coating offers improved resistance to the development of microscopic cracks that may develop in the insert and therefore provide access of vapor and gasses through the insert. In any case, the dielectric body 62' includes a circular shoulder 64' having a diameter that allows the body 62' to be slidably received within the cavity 20 between the respective dielectric sleeves 36, 38. Adjacent the shoulder 64' is a reduced circular section 66' concentric with the shoulder 64'. The junction of said shoulder 64' and section 66' is gently carved or filleted 68' to direct and support an O-ring 70, 70' about said section 66', see in particular FIGS. 9 to 11. Completing the structure of the dielectric body 62' are a pair axial extensions 72' which are dimensioned to be freely received within the respective dielectric sleeves 36, 38. By this arrangement, as will be apparent from the discussion of the assembly of the connector, the annular end surface 74 of sleeve 38 (see FIG. 9) will abut the annular end surface 76 of shoulder 64'. Likewise, as the various components are assembled into the housing 12, the annular end surface 78 of sleeve 36 will abut the O-ring 70, 70'that is received on the section 66'.

Figure 2:
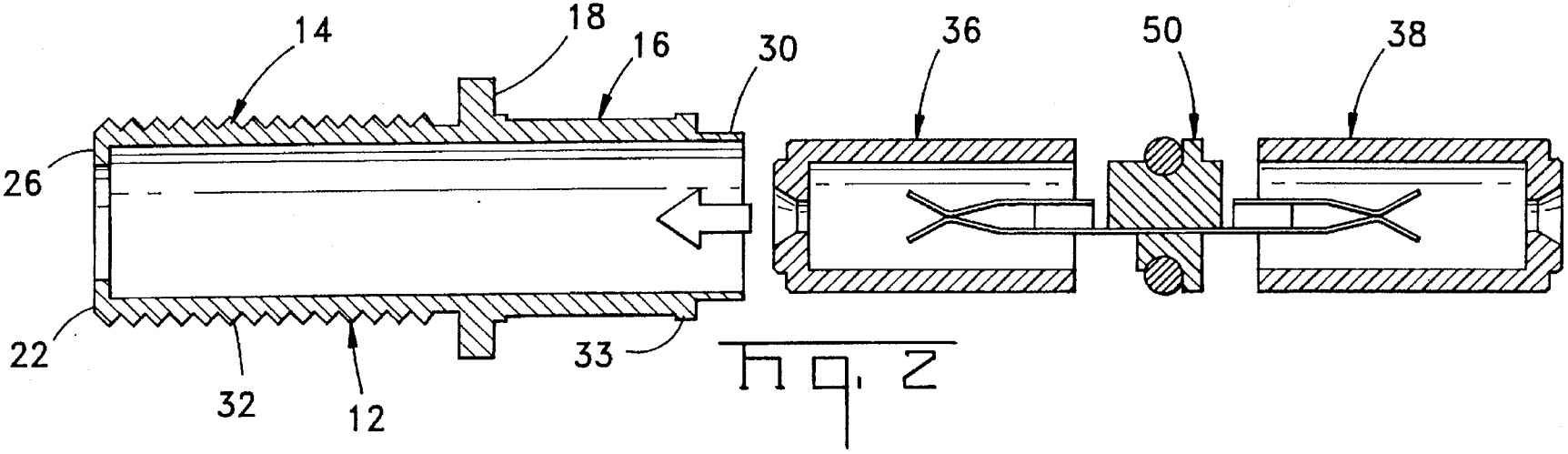

While alternate embodiments have been illustrated for the contacts 52, 52', the assembly sequence is identical in each case. Accordingly, attention is directed to a mix of the Figures to illustrate such sequence. FIGS. 2 and 3 show the housing loading sequence. FIG. 4 shows the fully loaded assembly, and FIG. 9 finally illustrates the crimped assembly ready for use in the selected environmental application.

Briefly, FIG. 2 depicts the several internal components axially positioned and sequentially arranged for entry into the cavity 20 of housing 12. With dielectric sleeve 36 fully received into the cavity, adjacent the restricted end flange 26, and the intermediate positioning of the insert molded element 50, 50' within the cavity 20, the second sleeve 38 is inserted into the cavity 20 (FIG. 3). FIG. 4 illustrates such components within the housing cavity 20 but in a relaxed or noncompressive state. Note that the shape of the O-ring is unchanged, i.e. not deformed, from its original relaxed state. However, to ensure an effective seal with the cavity wall of the housing 12, the components are moved relative to one another and retained in a slightly compressed state. This is accomplished by the application of an axial crimping force applied to the flange 30. That is, said flange is crimped inwardly against the annular shoulder 46 of dielectric sleeve 38. By this action, the end surface 74 of sleeve 38 is axially urged against the shoulder 64', which in turn is urged against the O-ring 70, 70'. However, since the insert molded element 50, and hence the O-ring 70, 70', are fixed relative to a location in the housing 12, the O-ring will yield and deform under the axially force of the crimping action. As the O-ring deforms, it tends to fill any voids thereabout and flatten against the wall of cavity 20. So long as the force is maintained by a properly crimped connector, an effective seal is maintained internally of the connector.

FIGS. 9 to 11 illustrate the further addition of a grounding sleeve 34, which may be formed of a stainless steel or copper alloy and slipped about the longitudinal section 16 and retained thereon between the flanges 18 and 33. The grounding sleeve 34 has been provided with plural lances 82 struck from the body of the sleeve. FIG. 11 illustrates the manner by which such lances effect grounding of the connector.

FIG. 11 is a partial, sectional view illustrating a typical application for the use of the connector 10 of this invention. Since a major purpose of this connector is to provide an electrical integrity check to an otherwise environmentally sealed box, such as a communication outlet, there is shown the wall 84 of such outlet having a threaded through hole 86 therein for threadably receiving the complementary threads 32 about the longitudinal housing section 16. To improve any necessary external sealing, an O-ring 88 may be incorporated adjacent the flange 18 which will be squeezed and deformed by the threading action of the connector against the wall 84. As an added feature, a sealing gel may also be used to fill any voids within the hole 86. Note that the threads 32 extend below and free of the outlet wall 84. To this free portion of the housing section 14, a temporary threaded cap 99 may be placed thereon until such time as access thereto is required.

A final complementary feature of the system to which the connector is applied is the provision of a circular grounding member 88 that is slipped over the longitudinal section 16. Note that a central opening 90 has been provided along the top to allow internal access to the connector. In the application of this connector to a communication outlet, such as a TV line amplifier, a typical component of such outlet is a printed circuit board (PCB) where contacts 92, projecting below the PCB, engage a respective connector 10 between the contact arms 56, 56'. To check the integrity of such connection, without opening the outlet and unnecessarily exposing the components thereof to the atmosphere, a simple probe 94 may be inserted from the bottom through the opening 44.

What is claimed is:

1. An environmentally sealed coaxial feedthrough coupling connector for connecting to a contact of a communication system at one end thereof and means at the opposite end for testing the integrity of said contact with said communication system, said coupling connector comprising, a.) a metal housing having a first longitudinal section and a second longitudinal section with an essentially uniform circular cavity of a predetermined diameter therethrough, b.) a pair of insulating sleeves slidably received and axially spaced within said circular cavity, c.) a dielectric insert separating said insulating sleeves, said insert characterized by an electrical contact extending axially therethrough into said respective insulating sleeves, said insert further characterized by a diametrical portion to be received within said circular cavity, where said diametrical portion includes an annular portion between said sleeves for receiving a compressible O-ring, d.) an O-ring within said annular portion for compressive engagement with the internal wall of said housing cavity whereby the relative movement of said insulating sleeves during the assembly thereof axially compresses said O-ring causing it to laterally expand against said internal wall and thereby effect an internal, environmental seal within said coupling connector.

2. The environmentally sealed coaxial feedthrough coupling connector according to claim 1 wherein said metal housing includes an external flanged member separating said first and second longitudinal sections.

3. The environmentally sealed coaxial feedthrough coupling connector according to claim 2 wherein said first longitudinal section is externally threaded throughout its length for engaging complementary hole and for receiving a complementary cap member at its open end.

4. The environmentally sealed coaxial feedthrough coupling connector according to claim 1 wherein external sealing means are provided about said connector.

5. The environmentally sealed coaxial feedthrough coupling connector according to claim 1 wherein said electrical contact is a one-piece contact molded into said dielectric insert, where said contact includes engaging portions at its respective ends.

6. The environmentally sealed coaxial feedthrough coupling connector according to claim 1 wherein said insulating sleeves and said dielectric insert are fed into said circular cavity through the open end of said second longitudinal section, and said open end includes an axially extending flange which is capable of being crimped inwardly into contact with the end of one of said insulating sleeves.

7. The environmentally sealed coaxial feedthrough coupling connector according to claim 1 wherein said diametrical portion is dimensioned to be slidably received in said circular cavity and includes a laterally directed annular surface against which said O-ring may be compressed.

8. The environmentally sealed coaxial feedthrough coupling connector according to claim 1 wherein said electrical contact is provided with a cured conformal plastic coating prior to being molded within said insert.

* * * * *